US010330387B2

(12) United States Patent
Zivanovic et al.

(10) Patent No.: US 10,330,387 B2
(45) Date of Patent: Jun. 25, 2019

(54) SECURING DEVICE FOR A CYLINDRICAL CERAMIC HOLLOW BODY AND FIREPROOF CERAMIC GAS PURGING BRICK HAVING SUCH TYPE OF SECURING DEVICE

(71) Applicant: Refractory Intellectual Property GmbH & Co. KG, Vienna (AT)

(72) Inventors: Bojan Zivanovic, Vienna (AT); Bernhard Handle, Vienna (AT)

(73) Assignee: Refractory Intellectual Property GmbH & Co. KG, Vienna (AT)

( * ) Notice: Subject to any disclaimer, the term of this patent is extended or adjusted under 35 U.S.C. 154(b) by 168 days.

(21) Appl. No.: 15/119,713

(22) PCT Filed: Jul. 28, 2015

(86) PCT No.: PCT/EP2015/067204
§ 371 (c)(1),
(2) Date: Aug. 17, 2016

(87) PCT Pub. No.: WO2016/050380
PCT Pub. Date: Apr. 7, 2016

(65) Prior Publication Data

US 2017/0051979 A1 Feb. 23, 2017

(30) Foreign Application Priority Data

Sep. 29, 2014 (EP) ..... 14186888

(51) Int. Cl.
*F27D 3/16* (2006.01)
*B22D 1/00* (2006.01)
(Continued)

(52) U.S. Cl.
CPC ..... *F27D 3/16* (2013.01); *B22D 1/005* (2013.01); *C21C 5/34* (2013.01); *C21C 5/48* (2013.01);
(Continued)

(58) Field of Classification Search
CPC ..... B22D 1/005; C21C 2250/08; C21C 5/34; C21C 5/48; C21C 7/072; F27D 2003/167; F27D 3/16
(Continued)

(56) References Cited

U.S. PATENT DOCUMENTS 4,789,141 A * 12/1988 Bates ..... B22D 1/005 266/218

FOREIGN PATENT DOCUMENTS

EP 0252684 A1 1/1988
EP 0502256 A2 9/1992
(Continued)

OTHER PUBLICATIONS

Hammerer, W., "Application of Purging Plugs in Ladle Metallurgy", Veitsch-Radex Rundschau, vol. 1, 1998, pp. 30-40.
(Continued)

*Primary Examiner* — Scott R Kastler
*Assistant Examiner* — Michael Aboagye
(74) *Attorney, Agent, or Firm* — Medley, Behrens & Lewis, LLC

(57) ABSTRACT

To improve the position of a cylindrical ceramic hollow body the invention relates to a securing device for use with a gas purging brick, where the securing device has the following characteristics in its operational position: A base body which, with its bottom and a circumferential wall, defines a cylindrical space with a corresponding central longitudinal axis, the bottom features an opening whose longitudinal axis aligns with the central longitudinal axis the
(Continued)

Figure 1:
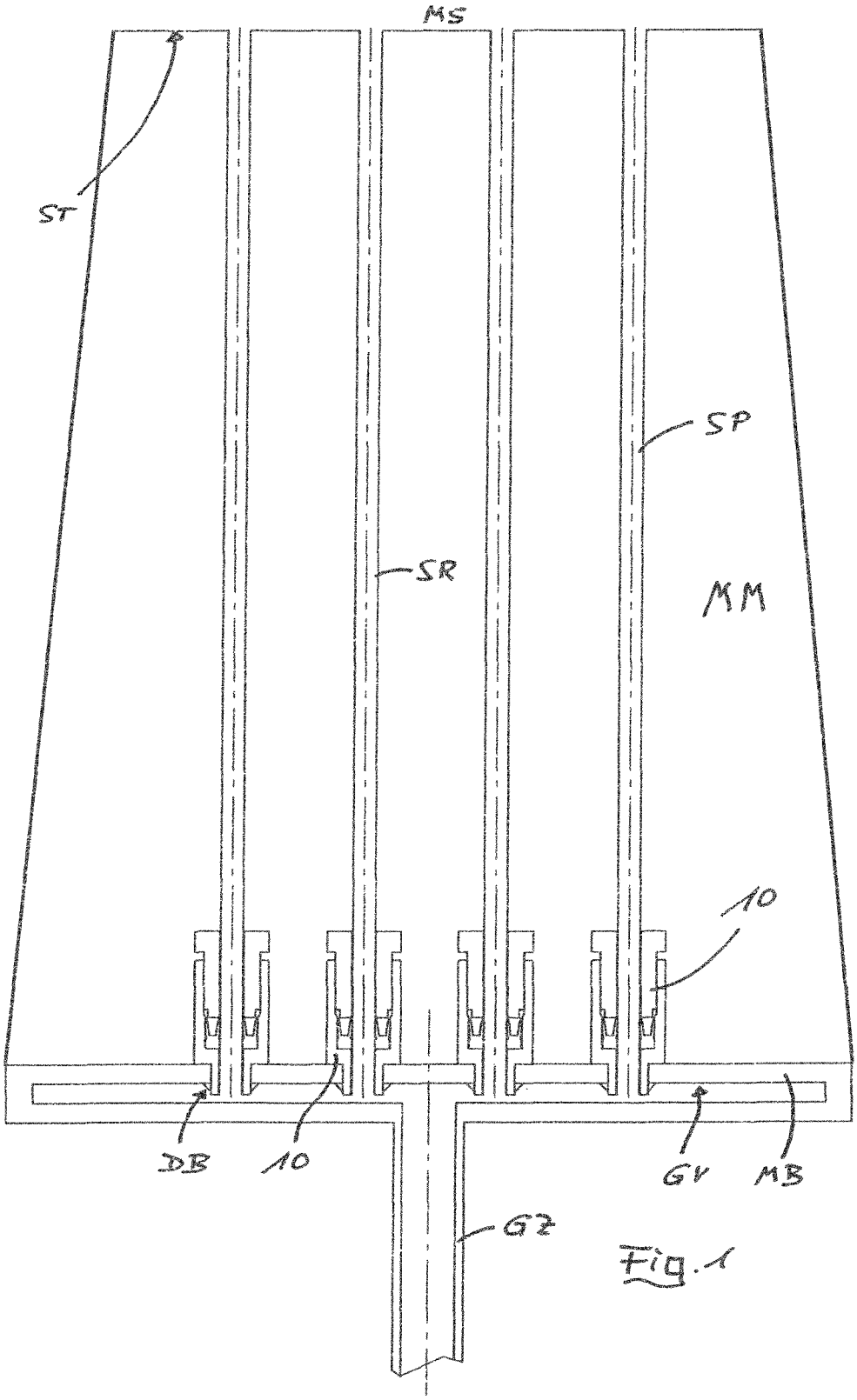

bottom features a ring-shaped channel which extends concentrically around the opening. at least an inner wall of the channel which is adjacent to the opening consists of a material which is plastically ductile under the application of pressure, a ring-shaped compact whose radial wall cross-section increases in size upwards from a lower free end, so that the inner wall of the channel deforms plastically, thereby reducing the cross section of the opening, after the compact is pressed into the channel.

13 Claims, 2 Drawing Sheets

(51) Int. Cl.
*C21C 5/48* (2006.01)
*C21C 7/072* (2006.01)
*C21C 5/34* (2006.01)

(52) U.S. Cl.
CPC ..... *C21C 7/072* (2013.01); *C21C 2250/08* (2013.01); *F27D 2003/167* (2013.01)

(58) Field of Classification Search
USPC ..... 266/220, 265, 217, 218, 270
See application file for complete search history.

(56) References Cited

FOREIGN PATENT DOCUMENTS

| | | | |
|---|---|---|---|
| EP | 0776983 | A1 | 6/1997 |
| GB | 2236114 | A | 3/1991 |
| WO | 9012895 | A1 | 11/1990 |
| WO | 9421406 | A1 | 9/1994 |
| WO | 2004056505 | A1 | 7/2004 |

OTHER PUBLICATIONS

Paul, et al., "Experiences with Porous Plugs with Directional Porosity at Badischen Stahlwerke AG", 1987, pp. 288-302.

* cited by examiner

L M
SR 18O
18K
18
S
18B
18V
18A
12
12I
12W
18U
16
12R
14A
14N
14II
14L
14AA
14R
16U
14
14B
12O
MB
12B
12E
DB
V
M L

SECURING DEVICE FOR A CYLINDRICAL CERAMIC HOLLOW BODY AND FIREPROOF CERAMIC GAS PURGING BRICK HAVING SUCH TYPE OF SECURING DEVICE

The invention relates to a securing device for a cylindrical ceramic hollow body, such as for example is used in fireproof ceramic gas purging bricks in order to enable a so-called directed porosity in the gas purging brick.

The gas purging brick is mounted into the base or the wall of a metallurgical vessel in order to treat a metal melt with a gas which is jetted into the metal melt via the gas purging brick.

A gas purging brick with directed porosity is characterised by the treatment gas being transported from a first, so called cold end of the gas purging brick, to a second, so called hot end of the gas purging brick, via a defined, mainly linear flow path. The hot end is the end which is in contact with the metal melt.

The directed porosity can be formed either via slits or drillings in a refractory matrix-material. This method is particularly difficult for larger gas purging elements, hence why cylindrical ceramic hollow bodies (called purging tubes in the following) were developed which are surrounded by a dense refractory matrix material.

These cylindrical ceramic bodies consist of a dense, temperature resistant ceramic material (for example on the basis of aluminium oxide —alumina —and/or zirconium oxide —zirconia —) and feature one or more flow-through channels (channels for the flow of the gas) extending in an axial direction.

These "purging tubes" have to be secured precisely and as gastight as possible in the gas purging brick. To achieve this, different securing devices are known into which the purging tubes are clamped in. In order to achieve a fixation free of play, ductile (deformable) carbon gaskets (seals) are used.

These carbon gaskets however suffer from the disadvantage that they are destroyed (combusted) upon contact with an oxygenated gas at the high application temperatures.

The object of the invention is therefore to provide a securing device (fastening means) of the named type which allows for a secure and defined fixation of the purging tubes independent of the type of treatment gas used.

When looking for a solution to this problem the following thoughts occurred:

- The fixation as such within the gas purging brick and particularly within the refractory matrix material must be firm (fixed) and defined,
- The fixation of the purging tubes within the securing device must respect the fact that the purging tubes are brittle ceramic bodies which are not ductile,
- The materials for the securing device do not need to be high temperature resistant, since the securing device is mounted at the cold end of the gas purging brick, however the used materials need to fulfil their function even at high temperatures of a couple of hundred degrees Celsius which can occur there,
- for gas purging bricks with directed porosity it is common to distribute the gas to the individual purging tubes/purging channels via a so called gas distribution chamber in order to simplify the gas supply. Insofar it should be considered that the securing device can be connected to, or into the gas distribution chamber in a reliable fashion.

Surprisingly it was found that the fragile ceramic purging tubes (cylindrical hollow bodies) can be grouted securely and permanently in a securing device if some constructional features are considered.

In its most general embodiment, the invention therefore relates to a securing device for a cylindrical ceramic hollow body with the following characteristics in its operational position:

a) a base body which, with its bottom and a circumferential wall, defines a cylindrical space (volume) with a corresponding central longitudinal axis (M),
b) the bottom features an opening whose longitudinal axis (L) aligns with the central longitudinal axis (M),
c) the bottom features a ring-shaped channel (furrow) which extends concentrically around the opening,
d) at least the inner wall of the channel which is adjacent to the opening consists of a material which is plastically ductile under application of pressure,
e) a ring-shaped compact whose radial wall cross-section increases in size upwards from a lower free end, so that the inner wall of the channel deforms plastically and reduces the cross section of the opening after the compact (body) is pressed into the channel.

By deforming the inner wall inwardly (into the opening cross section) upon insertion of the compact, the desired fixation of the cylindrical ceramic body (of the purging tube), which was previously inserted into the securing device, including the named opening, is achieved.

Surprisingly it was shown that the surface deformation of the inner wall of the channel fulfils multiple tasks, namely:

- fixation of the purging tube
- positioning of the purging tube
- sealing between the purging tube and the securing device
- corrosion protection insofar as the plastically ductile material of the channel wall is chosen from a group which does not burn even under the supply of oxygen.

In terms of the best possible positioning, fixation and sealing of the purging tube within the securing device it is advantageous if the purging tube, opening and channel feature an axially symmetrical (rotationally symmetrical) geometry.

The cross section (particularly the diameter for round geometries) of the opening in the bottom of the securing device is withal identical or slightly larger than the cross section (the outer diameter) of the purging tube. This is analogously valid for the inner cross section (inner diameter) of the inner wall of the channel. In other words: the inner wall of the channel extends, in the extreme case, aligned to the outer wall of the opening, or rather forms an upper section of the opening. Thereby the axial length of the opening is enlarged whereby the purging tube, which is placed in the opening, can be guided and fixated better.

The (ring shaped) channel itself can feature a rectangular cross section in the radial direction. Due to the conical cross section of the wall of the ring shaped compact it is still possible to deform the inner wall of the channel in the direction towards the purging tube when the compact is driven into the channel from above. Due to the axially symmetric geometry, the force distribution across the perimeter is even. Stress peaks are avoided.

The ring shaped channel in the bottom can also feature a cross section which, viewed in the radial direction of the channel, enlarges upwardly towards the open end. In other words: the inner wall of the channel features a wall thickness which reduces towards the free end. In this case—quasi in kinematic inversion—a ring shaped compact (rigid body)

with even wall thickness can also be used as long as the wall thickness is larger than the width of the channel in the vertically lower segment.

In all cases, the shape of the compact is to be chosen in such a way that it can enter the channel over a small distance (in order to position the channel and the compact to each other) in an unloaded manner, before the compact is driven further into the channel in the axial direction of the securing device, deforming the inner wall, and if applicable also the outer wall of the channel. The ductility of the inner wall of the channel (the wall which confines the channel in the direction towards the bottom opening of the casing) is increased if this inner wall features one or more recesses or cavities on its inner and/or outer surface, for example in the form of circumferential grooves.

The simultaneous deformation of the outer wall of the channel has the advantage that an additional fixation to the base body of the securing device is made possible, which is especially important when the ring shaped channel extends in a discrete (individual) element which forms an upper segment of the bottom and is arranged generally without any play in the space. "Generally without play" means that the element can be easily inserted into the space at the assembly of the securing device, but remains in its final position once it is reached. This outer wall of the channel can also feature recesses on its inner and/or outer surface (the outer surface lies at the base body), as they were described previously for the inner wall.

Due to these recess(es), the desired deformation and therefore the clamping and sealing effect of the compact in the counterpart (with reference to the walls of the channel) is optimised.

The recess(es) can for example feature a saw-tooth-like profile which is, amongst other things, characterised by the fact that at least one wall of the recess extends at an angle other than 90° to the surface of the corresponding body.

An embodiment for this is displayed in one of the following embodiments.

Insofar, the entire element can be made of a material which is ductile in a plastic manner under the application of pressure.

The compact itself can also be made of a material which is ductile in a plastic manner under the application of pressure.

The plastically ductile material is further characterised as follows:

Generally any material can be considered which, besides a sufficient basic strength, has a higher ductility (under a load) than the ceramic material of the purging tube. Generally, pig-iron could for example be used. A reasonable selection can be made using the strength (in MPa) of the materials. For ceramic materials, the compressive strength is determined according to Austrian Standard ÖNORM EN 993-5:1998. For the ductile, particularly metallic materials the tensile strength is determined according to DIN EN ISO 6892-1:2009.

The ceramic material (for example on the basis of alumina Al2O3) of the hollow bodies generally has a compressive strength in the area of 2000 to 3000 MPa. The ductile material of the sealing walls (especially the wall on the inner side of the channel or of the entire discrete element including the channel) for example comprises materials on the basis of copper, copper-tin, copper-tin-zinc, copper-zinc, copper-aluminium, copper-led, copper-nickel, copper-nickel-zinc, aluminium etc. Typical tensile strengths of these materials are less than 600 MPa, often <500 MPa, <400 MPa or <300 MPa.

The axial length of the securing (fixation) of the purging tubes in the securing device can differ, the longer the better. Multiple securing devices can be assembled (placed) axially in series and/or at the same axial height adjacent to each other within the refractory matrix material of a gas purging brick.

According to one embodiment the securing device features a lid which is attachable to the base body. The lid features a lid opening which extends concentrically to the opening in the bottom of the base body.

In this embodiment the purging tube is therefore guided in at least two places at a distance to each other, namely in the area of the opening in the lid and in the area of the opening in the bottom of the base body.

This guidance for the purging tube can be optimised if the lid features an extension which protrudes into the volume of the base body and if this extension comprises an axial extension of the lid opening. This allows for a lid-sided stabilisation of the purging tube along a certain axial length.

The axially extending extension of the lid is preferably designed in such a way that it sits in the base body in a form fitted manner. Thereby a sort of "pipe in pipe fixation" is created.

The lid can for example be screwed onto the base body. The thread can extend along the extension and interact with an inner thread on the inside of the base body, as displayed in the following figure.

If the extension reaches to the bottom of the base body (in its mounted state), a continuous axial guidance for the purging tube is created. One end of the gas purging tube protrudes into the opening at the bottom (gas is supplied via this opening mainly from a gas distribution chamber of the gas purging element) and a substantial part of the purging tube protrudes beyond the securing device at the top and extends subsequently through the ceramic matric material of the purging element up to the gas-exit-sided end.

For the corresponding gas purging element, which is also subject of this invention, the following characteristics are valid in an operational position in the bottom of a metallurgic vessel:

- The gas purging brick comprises a gas distribution chamber at the lower end,
- Multiple securing devices of the named type are arranged at a distance to each other in the area of a ceiling of the gas distribution chamber, wherein
- Each securing device holds a cylindrical ceramic hollow body, each of which extends through a ceramic base material of the gas purging brick up to its upper face.

If the base body of the securing device is made of metal, the securing device can be easily attached to the metal ceiling of the gas distribution chamber, for example by welding. In order to do so the securing devices are lead through corresponding through holes in the metal ceiling and consecutively welded.

It is important that gas supply from the gas distribution chamber through the openings in the base of the securing device into the purging tubes is possible.

Further features of the invention will become apparent from the characteristics of the sub claims as well as the further application documents.

In the following, the invention is further described by the means of different embodiments.

The figures show—each in a schematic representation:

FIG. 1: a vertical longitudinal section through a gas purging brick

Figure 2:
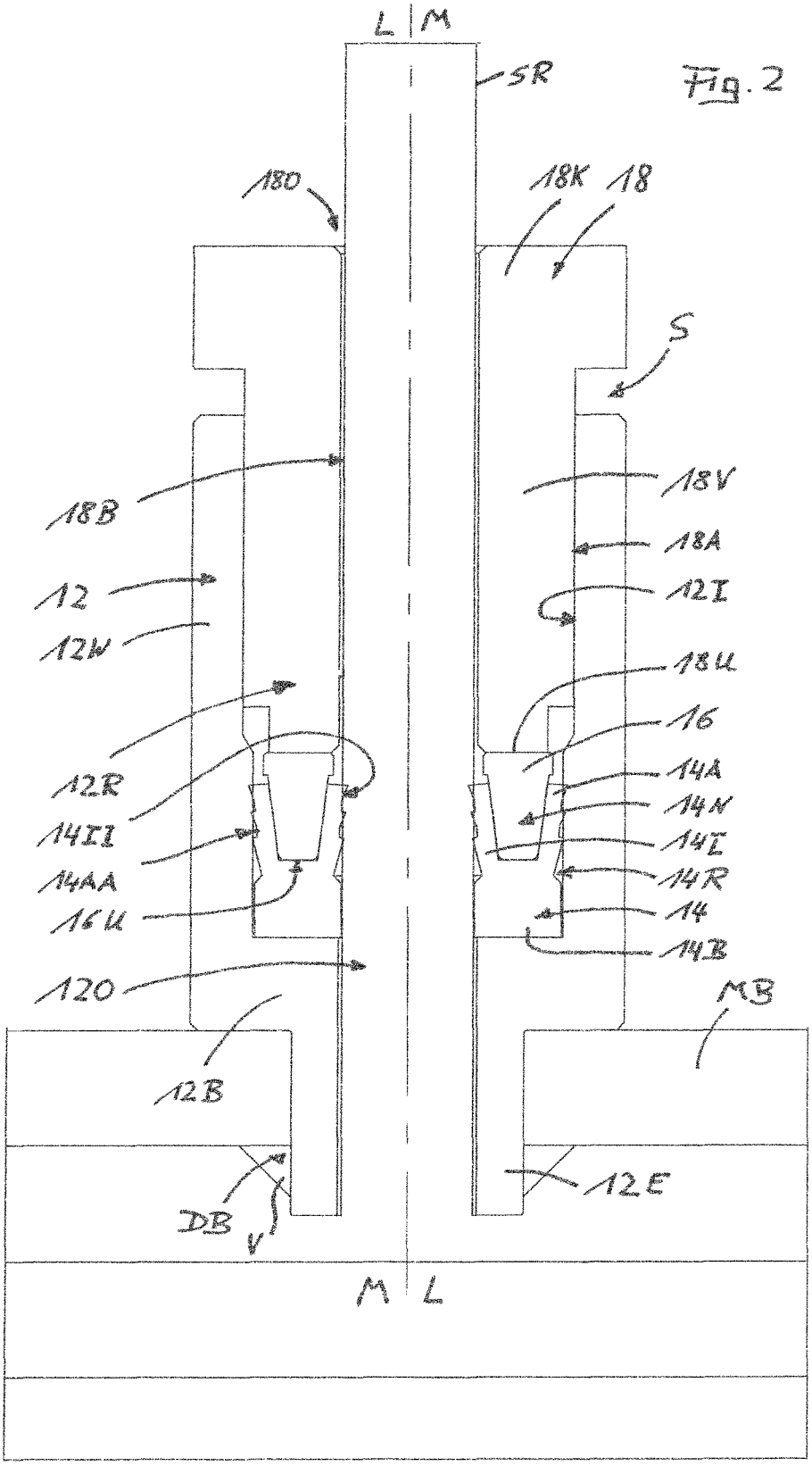

FIG. 2: a vertical longitudinal section through a securing device in connection with a gas distribution chamber of a gas purging brick.

In the following figure description all details refer to the mounting (position) of a gas purging brick in the bottom of a metallurgic vessel, such as a ladle, wherein a treatment gas flows through the gas purging element in the axial direction from the bottom to the top.

The gas purging device shown in FIG. 1 features a gas supply pipe GZ which discharges into a gas distribution chamber GV at the lower (cold) end of the gas purging brick.

The gas distribution chamber is confined by a metal sheet MB at the upper end. The metal sheet MB features multiple through holes DB, four of which can be seen in FIG. 1.

A lower end 12E of a securing device 10, as it is further described in the following, extends through each through hole DB.

A (one) cylindrical ceramic hollow body, also called purging tube SR, extends through each securing device 10. Each purging tube SR lies in the region of the through hole DB with a lower end, and extends in its axial direction through a matrix material MM of the gas purging brick up to its face ST, wherein the face ST touches a metal melt MS in the operational position.

A treatment gas is correspondingly fed through the gas supply pipe GZ, flows through the gas distribution chamber GV and the through holes DB into the purging tubes SR before it exits the purging tubes SR via the face ST and flows into the metal melt MS.

Because the gas flows through the gas purging brick more or less in one direction (axially), this gas purging brick can be identified as a gas purging brick with directed porosity, even though the matrix material MM is generally gastight.

FIG. 2 shows a securing device 10 in concurrence with the metal sheet MB, thus the ceiling of the gas distribution chamber GV.

The securing (fixation) device 10 consists of a base body 12 which, with its bottom 12B and a circumferential wall 12W, defines a cylindrical space (volume) 12R with a corresponding central longitudinal axis M.

The bottom 12B features an opening 12O whose longitudinal axis L aligns with the central longitudinal axis M.

A discrete element 14 which generally features a pot-shape, rests on the bottom 12B. The element 14 features a bottom 14B which rests on the bottom 12B of the base body 12 and thereby forms an upper segment of the bottom. The element 14 furthermore features an inner wall 14I and an outer wall 14A. A channel 14N is formed between the inner wall 14I and the outer wall 14A, which generally features a rectangular cross section in the unloaded state (not shown).

An inner surface 14II of the inner wall 14I and an outer surface 14AA of the outer wall 14A of the element 14 are characterised by multiple ring-shaped grooves 14R, which are connected in a saw-tooth-like fashion with each other (in the axial direction LM).

The securing device according to FIG. 2 is displayed in a state where the corresponding purging tube SR is already fixed in place, namely by the means of a ring-shaped compact 16. The compact 16 is characterised by the facts that its radial wall cross section enlarges from a lower free end 16U upwards, so that the inner wall 14I of the channel 14N, or rather the element 14 is deformed when the compact 16 is pressed into the channel 14N.

In other words: upon driving of the compact 16, the ring shaped inner wall 14I, which confines the channel 14N on the inside, has deformed radially to the inside and thereby connected to the outer wall of the purging tube SR, in fact over a certain surface area, and fixed the purging tube SR in the securing device 10 securely and in a gastight manner.

In order to achieve this deformation the element 14 is made of brass while the base body 12 is a steel body. Under the pressure of the compact 16 not only the inner wall 14I of the body 14 was deformed and has quasi turned into a gasket for the purging tube SR; simultaneously the outer wall 14A of the element 14 was also pushed radially to the outside and therefore clamped the element 14 into the base body 12.

The driving (pressing) of the heading tool/compact 6 occurs with the aid of a lid 18 in this embodiment, which features an axially extending extension 18V with an outer thread 18A below a head 18K, which interacts with a corresponding inner thread 12I of the base body.

Head 18K and the extension 18V feature a continuous drilling 18O which is used to position the purging tube SR without any play. The drilling 18O therefore generally extends concentrically/aligned with the opening 120 and to the free space which is confined by the inner wall 14I.

As soon as the lower face 18U of the lid 16 has reached the compact 16 it is further pushed downwards into the channel 14N in order to achieve the desired deformation, especially of the inner wall 14I, until the desired fixation of the purging tube SR is reached.

Between the lid head 18K and the corresponding upper rim of the base body 12 only a small slit S (for tolerances) will remain when the compact 16 is pressed into the channel 14N up to a maximum level.

The fixation of the securing device 10 onto the metal sheet MB takes place either by welding (weld V) in the region of the through hole DB or by the formation of corresponding inner/outer threads in the through hole DB and the outer surface of the lower, tapered end 12E of the base body 12.

The invention claimed is:

1. Refractory ceramic gas purging brick with the following characteristics in an operational position in a bottom of a metallurgic vessel:

a) a gas distribution chamber (GV) at a lower end b) multiple securing devices (10) which are arranged at a distance to each other in the area of a ceiling (MB) of the gas distribution chamber (GV), where c) each securing device (10) holds a cylindrical ceramic hollow body (SR), each of which extends through a ceramic base material (MM) of the gas purging brick up to its upper face, wherein each securing device comprises:

1) a base body (12) which, with its bottom (12B) and a circumferential wall (12W), defines a cylindrical space (12R) with a corresponding central longitudinal axis (M), 2) the bottom (12B) features an opening (12O) whose longitudinal axis (L) aligns with the central longitudinal axis (M), 3) the bottom (12B) features a ring-shaped channel (14N) which extends concentrically around the opening (12O), 4) at least an inner wall (14I) of the channel (14N) which is adjacent to the opening (12O) consists of a material which is plastically ductile under application of pressure, 5) a ring-shaped compact (16) whose radial wall cross-section increases in size upwards from a lower free end (16U), thereby reducing the cross section of the opening (12O), 6) a shape of the ring-shaped compact (16) is to be chosen in such a way that it is able to enter the channel (14N) over a small distance in an unloaded manner, before the compact (16) is pressed further into the channel (14N) in an axial direction of the securing device, wherein 7) the ring-shaped channel (14N) extends into a discrete element (14), which forms an upper segment of the bottom (12B) and is arranged without any substantial play in the space (12R).

2. Gas purging brick according to claim 1, wherein the ceiling (MB) of the gas distribution chamber (GV) consists of metal and the securing devices are attached in through holes (DB) of this ceiling (MB) by welding (S).

3. Securing device for a cylindrical ceramic hollow body (SR) in a gas purging brick, the securing device having the following characteristics in its operational position:

a) a base body (12) which, with its bottom (12B) and a circumferential wall (12W), defines a cylindrical space (12R) with a corresponding central longitudinal axis (M), b) the bottom (12B) features an opening (12O) whose longitudinal axis (L) aligns with the central longitudinal axis (M), c) the bottom (12B) features a ring-shaped channel (14N) which extends concentrically around the opening (12O), d) at least an inner wall (14I) of the channel (14N) which is adjacent to the opening (12O) consists of a material which is plastically ductile under application of pressure, e) a ring-shaped compact (16) whose radial wall cross-section increases in size upwards from a lower free end (16U), thereby reducing the cross section of the opening (12O), f) a shape of the ring-shaped compact (16) is to be chosen in such a way that is able to enter the channel (14N) over a small distance in an unloaded manner, before the compact (16) is pressed further into the channel (14N) in an axial direction of the securing device, wherein (g) the ring-shaped channel (14N) extends into a discrete element (14), which forms an upper segment of the bottom (12B) and is arranged without any substantial play in the space (12R).

4. Securing device according to claim 3, wherein the ring-shaped channel (14N) in the bottom (12B) features a rectangular cross section in the radial direction.

5. Securing device according to claim 3, wherein the ring-shaped channel (14N) in the base (12B) features a cross section which radially enlarges upwards, towards the open end.

6. Securing device according to claim 3, wherein the discrete element (14) is made of a material which is plastically ductile under the application of pressure.

7. Securing device according to claim 3, wherein the compact (16) is made of a material which is plastically ductile under the application of pressure.

8. Securing device according to claim 3, wherein the plastically ductile material is a material which is a material from the group which comprises the following materials: copper, copper alloys, aluminium, aluminium alloys, tin, tin alloys, zinc, zinc alloys.

9. Securing device according to claim 3 with at least one circumferential recess (14R) on at least one of the following surfaces: inner surface (14II) of the inner wall (14I), outer surface (14AA) of the outer wall (14A).

10. Securing device according to claim 3 wherein the recess (14R) features a saw-tooth-like profile.

11. Securing device according to claim 3 with a lid (18) which is attachable to the base body (12) and features a lid opening (18O) which extends concentrically to the opening (12O) in the bottom of the base body (12).

12. Securing device according to claim 11, wherein the lid (18) and the base body (12) can be screwed together.

13. Securing device according to claim 11, wherein the lid (18) features an extension (18V) which can be inserted into the space (12R) in a form-fitted manner and also features a drilling (18B) which extends concentrically to the lid opening (18O).

* * * * *